US005369967A

United States Patent [19]

Schmid et al.

[11] Patent Number: 5,369,967

[45] Date of Patent: Dec. 6, 1994

[54] DRAW-OFF MECHANISM FOR A FLAT BAR KNITTING MACHINE

[75] Inventors: Franz Schmid, Bodelshausen; Winfried Kapitel, Rottenburg, both of Germany

[73] Assignee: H. Stoll GmbH & Co., Reutlingen, Germany

[21] Appl. No.: 47,793

[22] Filed: Apr. 15, 1993

[30] Foreign Application Priority Data

Apr. 16, 1992 [DE] Germany ..... 4212793

[51] Int. Cl.[5] ..... D04B 15/90; D04B 15/88

[52] U.S. Cl. ..... 66/149 R

[58] Field of Search ..... 66/147, 149 R, 150, 66/152

[56] References Cited

U.S. PATENT DOCUMENTS

| | | | |
|---|---|---|---|
| 3,651,669 | 3/1972 | Findewirth et al. | 66/149 |
| 3,956,907 | 5/1976 | Murphy et al. | 66/149 R |
| 4,488,416 | 12/1984 | Shima et al. | 66/149 R |
| 4,503,689 | 3/1985 | Goller et al. | 66/149 R |
| 4,774,820 | 10/1988 | Mestre Mas | 66/149 R |
| 4,790,152 | 12/1988 | Geitner | 66/149 R |

FOREIGN PATENT DOCUMENTS

| | | | |
|---|---|---|---|
| 56997 | 9/1938 | Denmark | 66/149 R |
| 0421665 | 4/1991 | European Pat. Off. . | |
| 1816071 | 7/1969 | Germany | 66/149 R |
| 1813052 | 6/1970 | Germany . | |
| 7018597 | 9/1971 | Germany . | |
| 2650630 | 5/1977 | Germany . | |
| 3209480 | 10/1983 | Germany . | |
| 3075157 | 4/1988 | Japan | 66/149 R |
| 303637 | 6/1952 | Switzerland | 66/149 R |

*Primary Examiner*—Clifford D. Crowder
*Assistant Examiner*—John J. Calvert
*Attorney, Agent, or Firm*—Michael J. Striker

[57] ABSTRACT

The draw-off mechanism for a flat bar knitting machine having needle beds includes a pair of driven feed rollers arranged axially parallel to each other and located adjacent to the needle beds under a gap between the needle beds; a pair of pivoting levers, each pivoting lever being two-armed and having a feed roller mounted at one end thereof and an adjustable stop device for setting a minimum spacing between the feed rollers located at another end of each pivoting lever remote from the feed rollers; and a device for adjusting an initial tension on at least one of the pivoting levers to urge the pivoting levers closer together, so that the driven feed rollers can cooperate with each other and act on a workpiece running between them.

7 Claims, 3 Drawing Sheets

DRAW-OFF MECHANISM FOR A FLAT BAR KNITTING MACHINE

BACKGROUND OF THE INVENTION

The present invention relates to a draw-off mechanism for a flat bar knitting machine.

A draw-off mechanism for a flat bar knitting machine is known comprising at least one pair of feed rollers arranged axially parallel to each other and adjacent the needle beds under the gap between the needle beds. At least one feed roller of a pair of feed rollers is driven. At least one feed roller of that pair is mounted on a pivoting lever urged under tension toward the opposite feed roller of that pair.

Draw-off mechanisms of the above-described type are already known in several different forms, in which a feed roller of a pair of feed rollers is under an adjustable tension urging it toward the opposite feed roller. These draw-off mechanisms of the prior art in which the roller tension is adjustable have a comparatively expensive structure and are described in European Published Patent Application EP-OS 4,216,665. None of the above-mentioned draw-off mechanisms is however adapted for an article or workpiece being knitted on a flat bar knitting machine to a satisfactory and sufficient extent.

SUMMARY OF THE INVENTION

It is an object of the present invention to provide a draw-off mechanism for a flat bar knitting machine of the above-described type which is adapted to form different knit articles better than the current flat bar knitting machines.

This object is attained in a draw-off mechanism for a flat bar knitting machine of the above-described type having means for adjusting both a minimum spacing between the feed rollers of at least one pair of feed rollers and also means for setting or adjusting an initial tension on at least one pivoting lever carrying a feed roller of the at least one pair at the minimum spacing.

In the draw-off mechanism according to the invention both the minimum spacing between the feed rollers of each of the feed roller pairs and also the force on the feed rollers changes. Advantageously both feed rollers of a feed roller pair cooperating with each other can be adjustable and for this purpose each feed roller is mounted on adjacent ends of respective pivoting levers. Each pivoting lever is two-armed and at its other end opposite to the end on which a feed roller is mounted it has an adjustable stop means which sets the minimum distance between the feed rollers. This adjustable stop means can be formed advantageously by an movable but fixable first eccentric body or disk, which cooperates with an opposing stop surface which is stationary relative to the adjacent needle bed. These first eccentric bodies or disks can be arranged on an adjusting shaft common to all pivoting levers of one half of the draw-off mechanism.

The adjustability of the tension on the pivoting lever and the resulting pressure on the feed roller mounted on it can be provided in a known way by spring means, e.g. a coil spring. This spring can be connected in a simple way with its one end on the pivoting lever and with its other end on an adjustable clamping lever. In another embodiment compression or tension springs can be eliminated and the adjustable tension can be provided by an elastic bendable arm of the pivoting lever, which is acted on by an adjustable second eccentric body, especially an eccentric disk, mounted on a second adjusting shaft.

Because of the special adjustability of the minimum spacing of the feed rollers and their tension and particularly for both rollers of a feed roller pair, the goods feed mechanism may be very sensitively adjusted to fit different articles to be knit during operation of the knitting machine.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
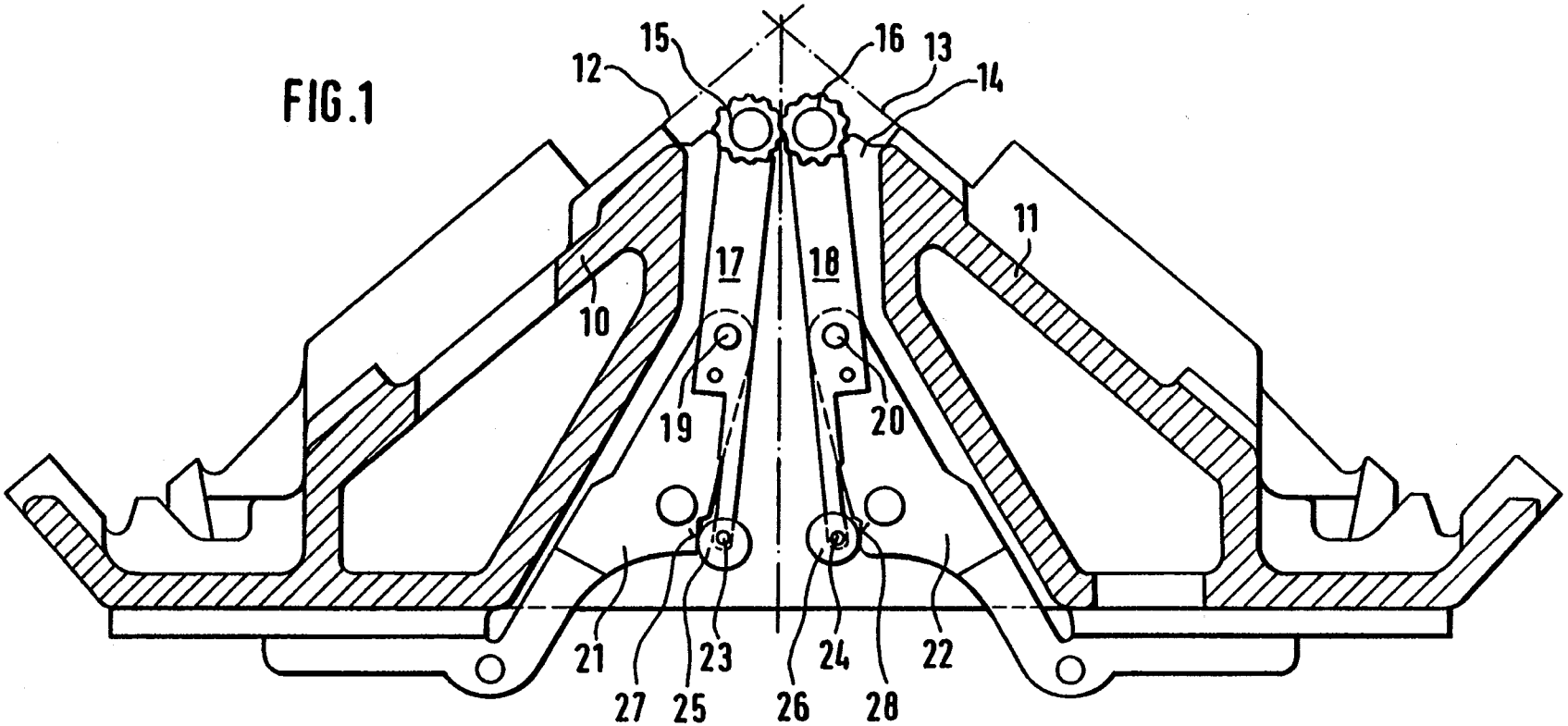
FIG. 1 is a schematic cross-sectional view through both needle beds of a V-Bed Flat Bar knitting machine showing the essential parts of a draw-off mechanism according to the invention.

The supporting members 10 and 11 for both needle boards of a flat bar knitting machine are shown in the cross-sectional view in FIG. 1. The unshown needles of the needle beds are arranged in the intersecting planes indicated by the dot-dashed lines 12 and 13. A goods draw-off mechanism is provided in the intervening space 14 called a gap below both of these planes 12 and 13 and between the needle beds. The draw-off mechanism consists of at least one pair of driven feed rollers 15,16 each having a profiled outer surfaces and extending axially parallel to each other. The unshown workpiece made with the needles of both needle beds runs between both feed rollers 15,16, is engaged by them and fed downward under tension. Both feed rollers 15 and 16 cooperating with each other are pivotally mounted on the two-armed pivoting levers 17 and 18. Each of the feed rollers 15 or 16 is mounted at one end of one of the two-armed pivoting levers 17 or 18. Each pivoting lever 17 or 18 is pivotally mounted in a central portion thereof on a supporting arm 21 or 22 so as to be pivotable about the pivot axle 19 or 20 which is attached to the supporting arm 21 or 22. The supporting arm 21 or 22 is attached to the lower side of one of the needle board supports 10 or 11. A first adjusting shaft 23 or 24 is attached to an end of the pivoting lever 17 or 18 remote from the feed roller 15 or 16 and on each pivoting lever. First eccentric disks 25 and 26 are attached to these first adjusting shafts 23 and 24. The first eccentric disk 25 or 26 is a stop element of the pivoting lever 17 or 18, which cooperates with an opposing stop surface 27 or 28 on the stationary supporting arm 21 or 22. A desired minimum spacing between both feed rollers 15 and 16 can be adjusted continuously to the thickness and type of the article to be knit by rotation of the first adjusting shafts 23 and 24, which adjusting shafts can pass continuously over the entire length of the needle bed. On the other hand, both feed rollers 15 and 16 may be moved away from each other, but only against a spring force acting on the pivoting levers 17 and 18.

Figure 2:
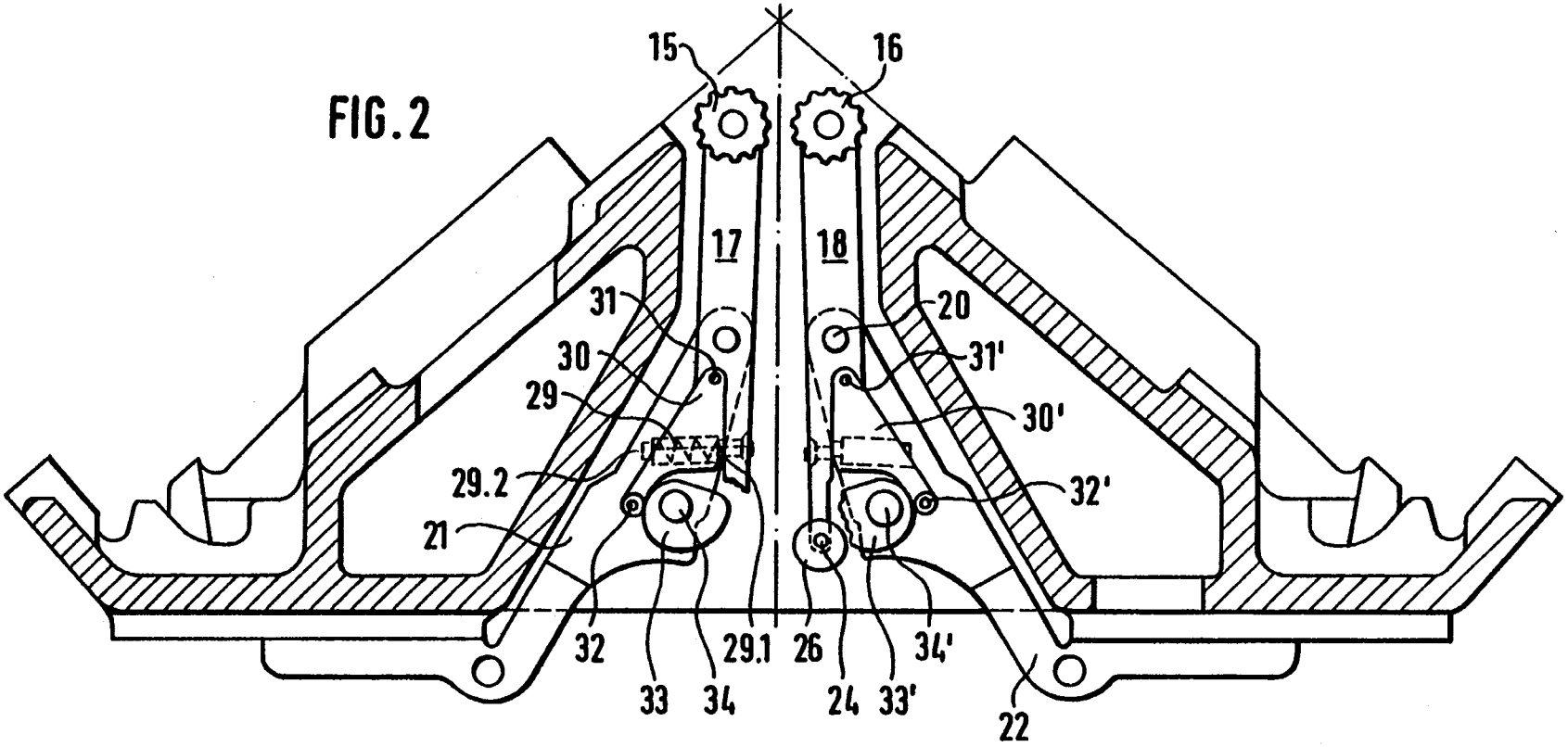
FIG. 2 is a cross-sectional view of the draw-off mechanism of FIG. 1 showing additional parts of the draw-off mechanism.

The spring means for providing the spring force is omitted from FIG. 1 for simplicity, but is shown in detail in FIG. 2.

In FIG. 2 both pivoting levers 17 and 18 and thus feed rollers 15 and 16 mounted on them are pivotable away from each other. The spring force, which must be overcome, is provided by a coil spring 29, which is attached with its one end 29.1 to a lower arm of the pivoting lever 17 and with its other end 29.2 to a clamping lever 30. The clamping lever 30 is pivotally mounted on the supporting arm 21 so as to be pivotable about its clamping pivot axle 31 and has a roller 32 on its lower end, with which it contacts against a second eccentric disk 33. The second eccentric disk 33 is attached to a second adjusting shaft 34, which can pass jointly through the entire length of the needle bed and through other clamp levers. By rotation of the second adjusting shaft 34 and thus the second eccentric disk 3, which is attached to it, the pivot position of the clamping lever 30 changes and thus the spacing between both ends 29.1 and 29.2 of the compression spring 29 changes which, in turn, changes the spring force acting on the pivoting lever 17 in the clockwise direction. The pivoting lever 18 carrying the other feed roller 16 is provided with exactly the same type of spring means, whose parts are indicated with the same reference numbers, but with an index mark or prime on those reference numbers (30',31',32',33',34').

Figure 3:
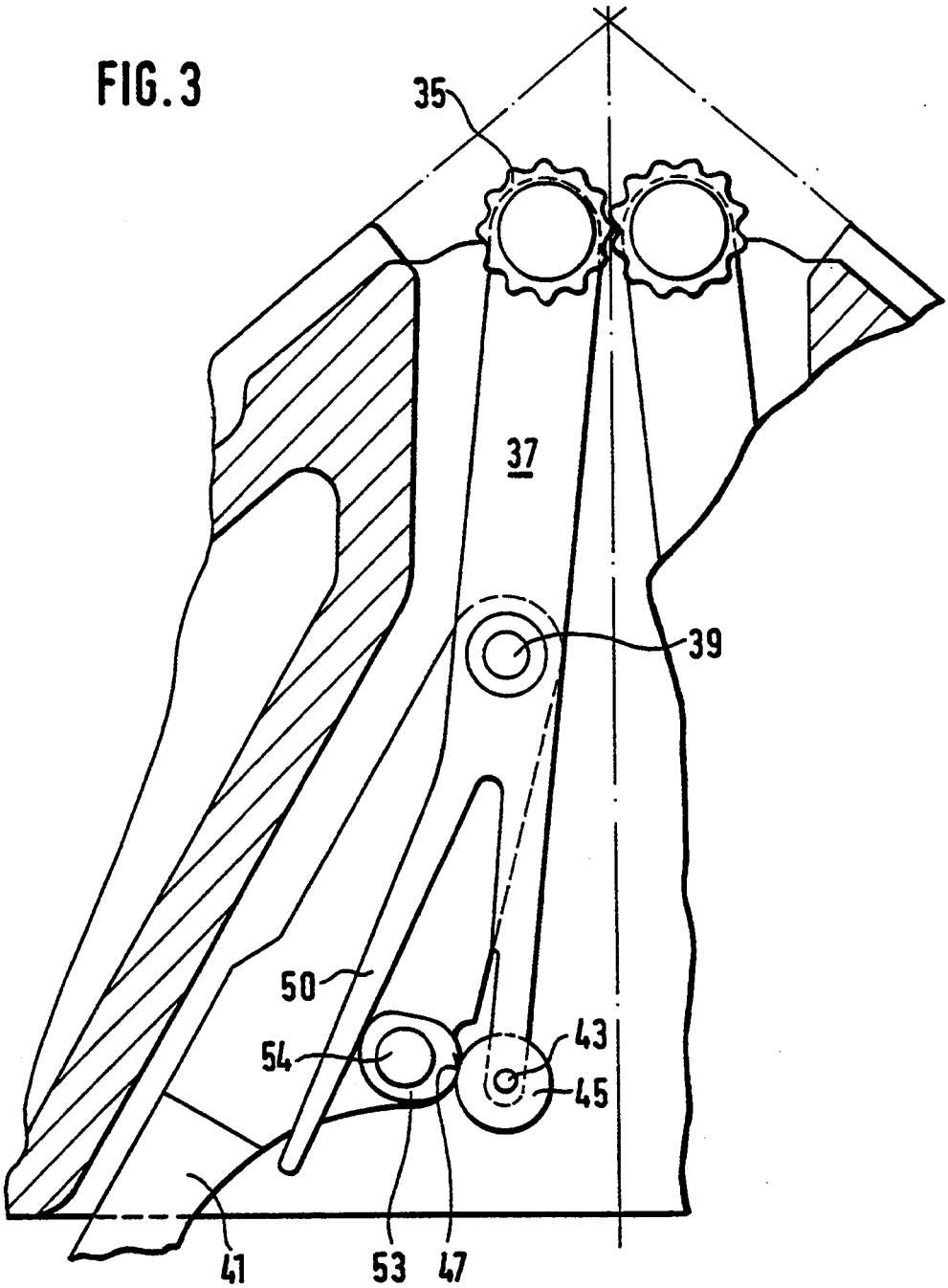
FIG. 3 is a detailed cutaway cross-sectional view of a different embodiment of a portion of the apparatus shown in FIGS. 1 and 2 including a pivoting lever supporting a feed roller of the draw-off mechanism.

FIG. 3 partially shows another embodiment of the goods draw-off mechanism which has a different type of spring means than the embodiment shown in FIGS. 1 and 2. The pivoting lever 37 carrying a feed roller 35 is formed with two arms like the pivoting lever 17 in the previous embodiment and is supported in its central portion so as to be pivotable about a pivot axle 39 on a stationary supporting arm 41. Like the pivoting lever 17 it carries on its lower end an adjusting shaft 43 provided with a first eccentric disk 45 and the first eccentric disk 45 is a stop element of the pivoting lever 37 which acts on an opposing stop surface 47 of the supporting arm 41. The pivoting lever 37 has a resilient member 50 which is a third arm, on whose free end portion a second eccentric disk 53 provides a clamping or tensioning means. The second eccentric disk 53 is attached to a second adjusting shaft 54, which corresponds to the first adjusting shaft 34 in the embodiment of FIGS. 1 and 2. The resilient member 50 may be elastically bent and, because of that, changes the initial tension acting on the feed roller 35.

While the invention has been illustrated and embodied in a goods draw-off mechanism for a flat bar knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Draw-off mechanism for a flat bar knitting machine having needle beds, said draw-off mechanism comprising:

at least one pair of feed rollers arranged axially parallel to each other and located adjacent to needle beds of a flat bar knitting machine under a gap between the needle beds, at least one of said feed rollers of said at least one pair of feed rollers being driven;

at least one pair of pivoting levers, each of said pivoting levers of said at least one pair of pivoting levers is two-armed, has one of said feed rollers mounted at one end thereof, has adjustable stop means for setting a minimum spacing between said feed rollers of said at least one pair of pivoting levers located at another end thereof remote from said feed rollers and is pivotable so that said feed rollers of said at least one pair of said pivoting levers can cooperate with each other; and means for adjusting an initial tension on at least one of said pivoting levers of said at least one pair of pivoting levers, said initial tension urging said pivoting levers of said at least one pair of pivoting levers closer together, so that said feed rollers of said at least one pair of said pivoting levers can cooperate with each other; and wherein said means for adjusting said initial tension comprises spring means including a movable clamping lever and a spring having two ends, one of said ends of said spring being attached to one of said pivoting levers and another of said ends of said spring being attached to said movable clamping lever.

2. Draw-off mechanism as defined in claim 1, wherein said adjustable stop means includes a movable but fixable first eccentric body rotatably connected with one of said pivoting levers of said at least one pair of said pivoting levers via a first adjusting shaft and an opposing stop surface arranged so as to be stationary relative to said needle beds, said first eccentric body being engagable with said opposing stop surface so that said first eccentric body cooperates with said opposing stop surface to determine said minimum distance; and wherein said means for adjusting said initial tension includes a second movable but fixable eccentric body attached to a second adjusting shaft so as to be rotatable by said second adjusting shaft to move the moveable clamping lever.

3. Draw-off mechanism as defined in claim 2, wherein said second adjusting shaft is connected to and common to a plurality of other second eccentric bodies.

4. Draw-off mechanism as defined in claim 1, wherein said one end of said spring acting on said pivoting lever is connected to said other end of said pivoting lever remote from said feed rollers and said clamping lever is pivotably mounted, and wherein said means for adjusting said initial tension includes a second eccentric body attached to a second adjusting shaft, said second eccentric body being pivotable by rotation of said second adjusting shaft to move said clamping lever.

5. Draw-off mechanism for a flat bar knitting machine having needle beds, said draw-off mechanism comprising:

at least one pair of feed rollers arranged axially parallel to each other and located adjacent to needle beds of a flat bar knitting machine under a gap between the needle beds, at least one of said feed rollers of said at least one pair of feed rollers being driven;

at least one pair of pivoting levers, each of said pivoting levers of said at least one pair of pivoting levers is two-armed, has one of said feed rollers mounted at one end thereof, has adjustable stop means for setting a minimum spacing between said feed rollers of said at least one pair of pivoting levers located at another end thereof remote from said feed rollers and is pivotable so that said feed rollers of said at least one pair of said pivoting levers can cooperate with each other; and means for adjusting an initial tension on at least one of said pivoting levers of said at least one pair of pivoting leers, said initial tension urging said pivoting levers of said at least one pair of pivoting levers closer together, so that said feed rollers of said at least one pair of said pivoting levers can cooperate with each other;

wherein said pivoting levers of said at least one pair of pivoting levers each include an elastic bendable arm and said means for adjusting said initial tension comprises spring means including said elastic bendable arms of said pivoting levers.

6. Draw-off mechanism as defined in claim 5, wherein said adjustable stop means includes a movable but fixable first eccentric body rotatably connected with one of said pivoting levers of said at least one pair of said pivoting leers via a first adjusting shaft and an opposing stop surface arranged so as to be stationary relative to said needle beds, said first eccentric body being engagable with said opposing stop surface so that said first eccentric body cooperates with said opposing stop surface to determine said minimum distance; and wherein said means for adjusting an initial tension includes a second movable but fixable eccentric body positioned to be engagable with one of said elastic bendable arms and attached to a second adjusting shaft, said second adjusting shaft being movable so that said second eccentric body engages and moves said elastic bendable arm engagable therewith.

7. Draw-off mechanism as defined in claim 6, wherein said second adjusting shaft is connected to and common to a plurality of other second eccentric bodies.

* * * * *